US005986579A

United States Patent [19]

Halvorson

[11] Patent Number: 5,986,579

[45] Date of Patent: Nov. 16, 1999

[54] METHOD AND APPARATUS FOR DETERMINING RAILCAR ORDER IN A TRAIN

[75] Inventor: David H. Halvorson, Cedar Rapids, Iowa

[73] Assignee: Westinghouse Air Brake Company, Germantown, Md.

[21] Appl. No.: 09/127,408

[22] Filed: Jul. 31, 1998

[51] Int. Cl.[6] ..... G08G 1/01; B61L 3/00

[52] U.S. Cl. ..... 340/933; 340/825.06; 340/825.05; 340/531; 340/310.01; 246/1 C; 246/6; 246/122 R; 246/167 R; 104/88.03; 701/19

[58] Field of Search ..... 340/933, 531, 340/825.05, 825.13, 425.5, 825.06, 310.01; 246/1 C, 2 E, 3–6, 122 R, 124, 166.1, 167 R; 104/88.02, 88.03, 88.04–88.06, 297; 370/252, 909; 701/19

[56] References Cited

U.S. PATENT DOCUMENTS

| | | | |
|---|---|---|---|
| 3,721,820 | 3/1973 | Caulier et al. | 246/247 |
| 4,041,470 | 8/1977 | Slane et al. | 340/505 |
| 4,689,602 | 8/1987 | Morihara et al. | 340/536 |
| 4,702,291 | 10/1987 | Engle | 105/35 |
| 4,825,189 | 4/1989 | Honma et al. | 246/166.1 |
| 5,168,273 | 12/1992 | Solomon | 340/505 |
| 5,361,070 | 11/1994 | McEwan | 342/21 |
| 5,457,394 | 10/1995 | McEwan | 324/642 |
| 5,510,800 | 4/1996 | McEwan | 342/387 |
| 5,512,834 | 4/1996 | McEwan | 324/642 |
| 5,603,556 | 2/1997 | Klink | 303/22.6 |
| 5,630,216 | 5/1997 | McEwan | 455/215 |
| 5,651,517 | 7/1997 | Stevens et al. | 246/2 |
| 5,777,547 | 7/1998 | Waldrop | 340/538 |

FOREIGN PATENT DOCUMENTS 0808761 11/1997 European Pat. Off. .

*Primary Examiner*—Donnie L. Crosland
*Attorney, Agent, or Firm*—Whitham,Curtis & Whitham

[57] ABSTRACT

A method and apparatus for determining railcar order in an ECP equipped train involving the inherent propagation delay of a pneumatic signal propagation in a brake air line as measured by each car and used to determine the car order in the train.

30 Claims, 4 Drawing Sheets

METHOD AND APPARATUS FOR DETERMINING RAILCAR ORDER IN A TRAIN

BACKGROUND OF THE INVENTION

The present invention generally relates to train control systems and more particularly relates to control systems for trains which include both an intra-train electronic communication system which may be an electric power line, or an RF link, and a brake air line extending along the length of the train, and even more particularly relates to control systems utilizing both such lines.

In the past, the railroads have typically operated trains having only a single air line extending the length of the train. This air line was used for both providing a source of compressed air and a medium for propagating braking signals. While this system has been used extensively in the past, it has several drawbacks. Signaling via air pressure messages propagating through the air line has a limited propagation speed. For example, for a 150-car freight train, it may take fifteen seconds or more for a braking message to reach the $150^{th}$ car, thereby delaying the full application of the rail car brakes and consequently extending the distance required to stop the train. In recent years, the American Association of Railroads (AAR) and individual railroads have investigated using electronic controlled pneumatic (ECP) brake systems. These systems typically use electronic messages on a power line extending the length of the train to activate the brakes on each car because the electronic signal propagation velocity is theoretically limited only by the speed of light or about 983,571,056 feet per second in a free space environment. However, in a cable, the speed of electronic signal propagation may slow to 60 percent of the speed of light in a vacuum, which still would be about 590,000,000 feet per second. For a typical freight train consisting of 150 cars each approximately 60 feet long, a train length could be approximately 9,000 feet. An electronic signal in a cable will travel the length of the train in only about 15 micro seconds while a pneumatic signal is limited to the speed of sound in air or about 1,130 feet per second. However, in a pipe with numerous couplings, turns, and other restrictions, the pneumatic signal propagation may slow to between 600 and 900 feet per second. At 600 feet per second, this pneumatic signal will require about 100 milliseconds to propagate through each car or about fifteen seconds to propagate the length of the train. The ECP brake system allows for nearly instantaneous activation of the railcar brakes along the entire length of the train. These ECP systems have been tested in the field and now are being considered for definition in an AAR specification. Persons skilled in the art are aware of the existing AAR efforts and the numerous tests of ECP and ECP-like field tests which have occurred.

In the past, trains equipped with ECP brake systems have had a need for determining the order of railcars in the train. Since each railcar in an ECP equipped train has a unique identity and is individually addressable over the electronic power line, it has become desirable to know the precise railcar ordering in the train. In the past, the railcar ordering, if it were even done at all, was done manually by inspecting the railcar numbers on the side of the train. With trains extending over a mile and a half in length in some situations, this can be a significant task which requires considerable time which may delay the departure of a train.

Consequently, there exists a need for improved methods and apparatuses for determining railcar order in a train.

SUMMARY OF THE INVENTION

It is an object of the present invention to provide expeditious methods for determining railcar order in a train.

It is a feature of the present invention to utilize on-board computer processing and communication equipment to determine the railcar order.

It is an advantage of the present invention to eliminate the need for a railroad worker to walk the length of the train, making a list of the railcar order.

It is another object of the present invention to provide an inexpensive method and apparatus for determining railcar order in a train.

It is another feature of the present invention to utilize existing processing and communication hardware onboard ECP equipped trains.

It is another feature of the present invention to avoid the need for expensive additional hardware to make a railcar order determination.

It is yet another object of the present invention to provide a reliable method and apparatus for determining railcar order.

It is yet another feature of the present invention to utilize the reliable components already disposed on the train for use in an ECP braking system.

It is yet another advantage of the present invention to eliminate the error associated with human mistakes which might occur as a railroad worker creates a railcar order list while walking the length of the train.

The present invention is a method and apparatus for determining railcar order in a train which is designed to satisfy the aforementioned needs, provide the previously stated objects, include the above-listed features and achieve the already articulated advantages. In the present invention, the time, expense and reliability problems associated with manually preparing a railcar order list has been significantly reduced.

Accordingly, the present invention is a method and apparatus for determining railcar order in a train which utilizes the inherent differences in the propagation velocity of electronic signals and pneumatic signals to determine the railcar order in a train.

BRIEF DESCRIPTION OF THE DRAWINGS

The invention may be more fully understood by reading the following description of the preferred embodiments of the invention in conjunction with the appended drawings wherein.

DETAILED DESCRIPTION OF THE PREFERRED EMBODIMENT

Figure 1:
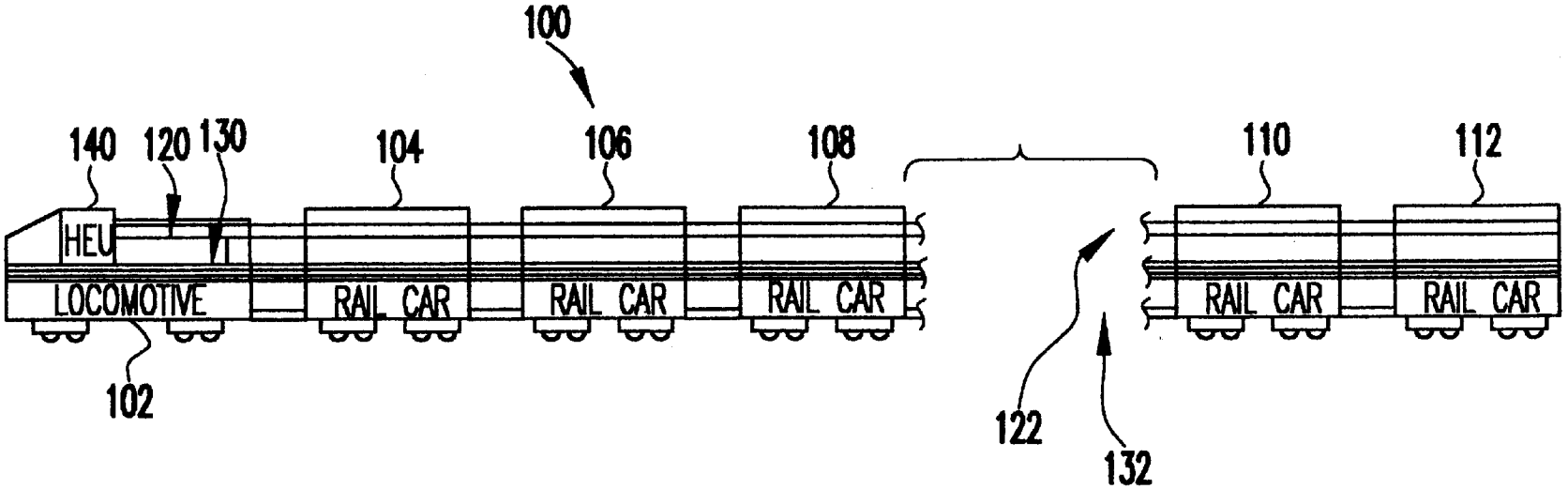
FIG.1 PRIOR ART
FIG. 1 is a simplified schematic diagram of a train, including a leading locomotive followed by numerous trailing railcars where the dark solid line represents an electrical power line extending the length of the train and the two parallel lines extending the length of the train are used to represent a brake air line extending the length of the train.

Now referring to the drawings, wherein like numerals refer to like matter throughout, and more particularly to FIG.

Figure 2:
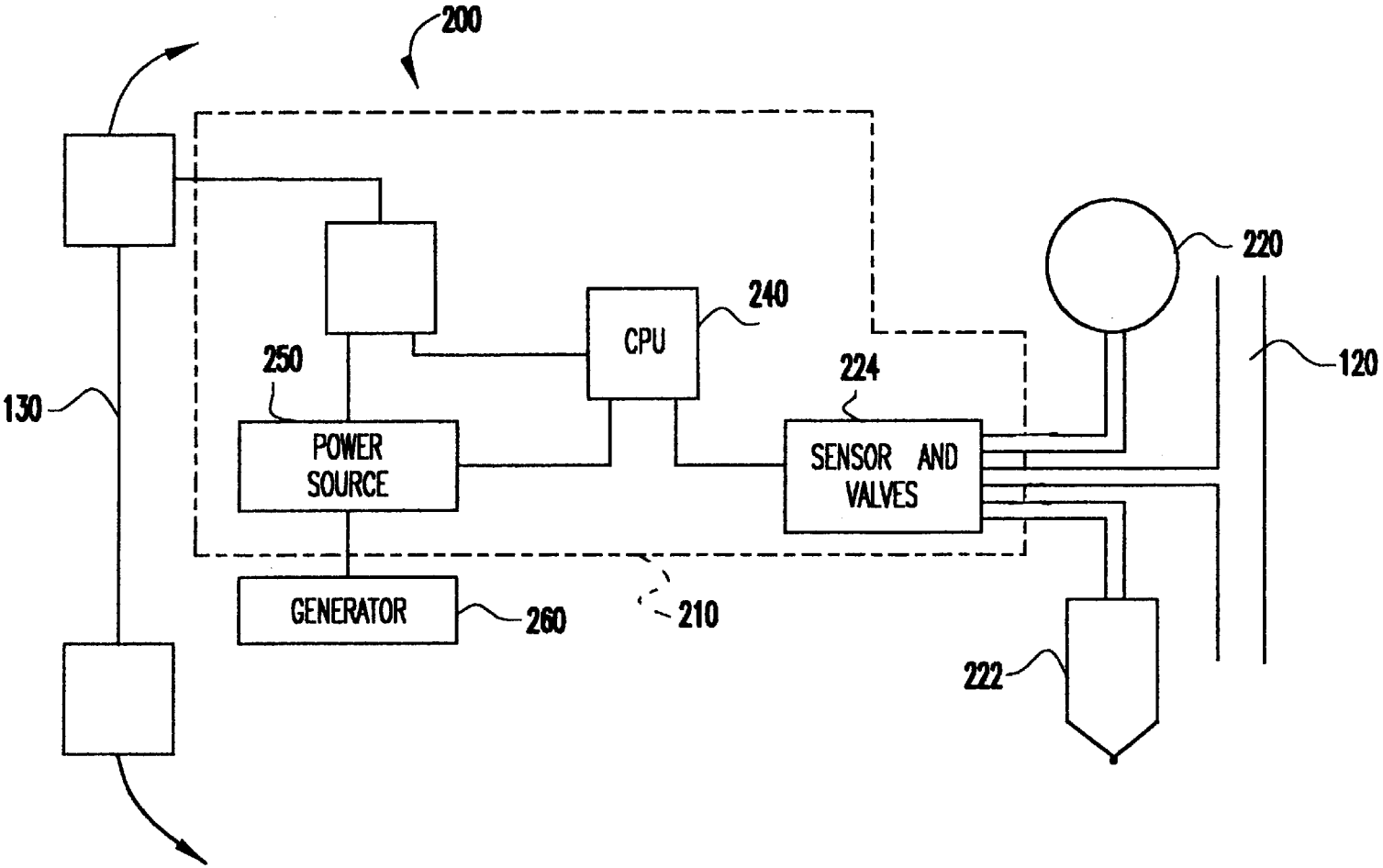
FIG. 2 is a simplified schematic diagram of a typical railcar of the prior art of FIG. 1.

1, there is shown an ECP equipped train, of the prior art generally designated 100, including a locomotive 102, railcar 104, railcar 106, railcar 108, railcar 110 and railcar 112. Extending the length of the train 100 is brake air pipe 120, which is shown by two closely spaced and separated parallel lines extending the length of the train and having a discontinuous section 122 disposed between railcar 108 and railcar 110 to signify the position for insertion of numerous other railcars therebetween. Extending the length of the train 100 is electronic power line 130, which is shown by a solid black line having a discontinuous section 132 disposed between railcar 108 and 110 to signify the position for inclusion of numerous other railcars disposed therebetween. It should be noted that the method of the present invention could be accomplished using another form of electronic communication, such as RF links between the railcars and the locomotive or other means of electronic communication. The train of FIG. 1 is intended to graphically display some of the key components of an ECP equipped train, which is known in the art. A more detailed depiction of the components of a typical ECP system for a typical railcar is shown in FIG. 2. A Head End Unit (HEU) 140, disposed in the locomotive, may be coupled to both line 130 and pipe 120. HEUs are well known in the art.

Now referring to FIG. 2, there is shown a detailed depiction of typical components of a prior art railcar equipped with an ECP system.

A system generally designated 200 is shown having a brake line 120 and a train line 130, which is an electrical power line and may be 230 volts. The train line may also be an electronic communication line. Coupled to brake line 120 are air reservoir 220, brake cylinder 222, and electronic pressure sensors/electronically controlled valves and pneumatically controlled valves 224, all of which are well known in the art. The precise pneumatic configuration will be a matter of industry standard and individual designers' choice. Coupled to the sensors and valves 224 is a communications interface/processor 240 which can be any type of communication interface or microprocessor. The precise communications interface and microprocessor will be a matter of industry standard and individual designer's choice. The interface/processor 240 is powered by a power source 250 which preferably has some battery component thereof and which in an optional embodiment would include an axle mounted generator 260 coupled thereto. The car control device (CCD) designated 210 can be coupled to other sensors and electronic equipment located on a railcar (not shown) via a smart car line which is an intra-car communication line.

Figure 3:
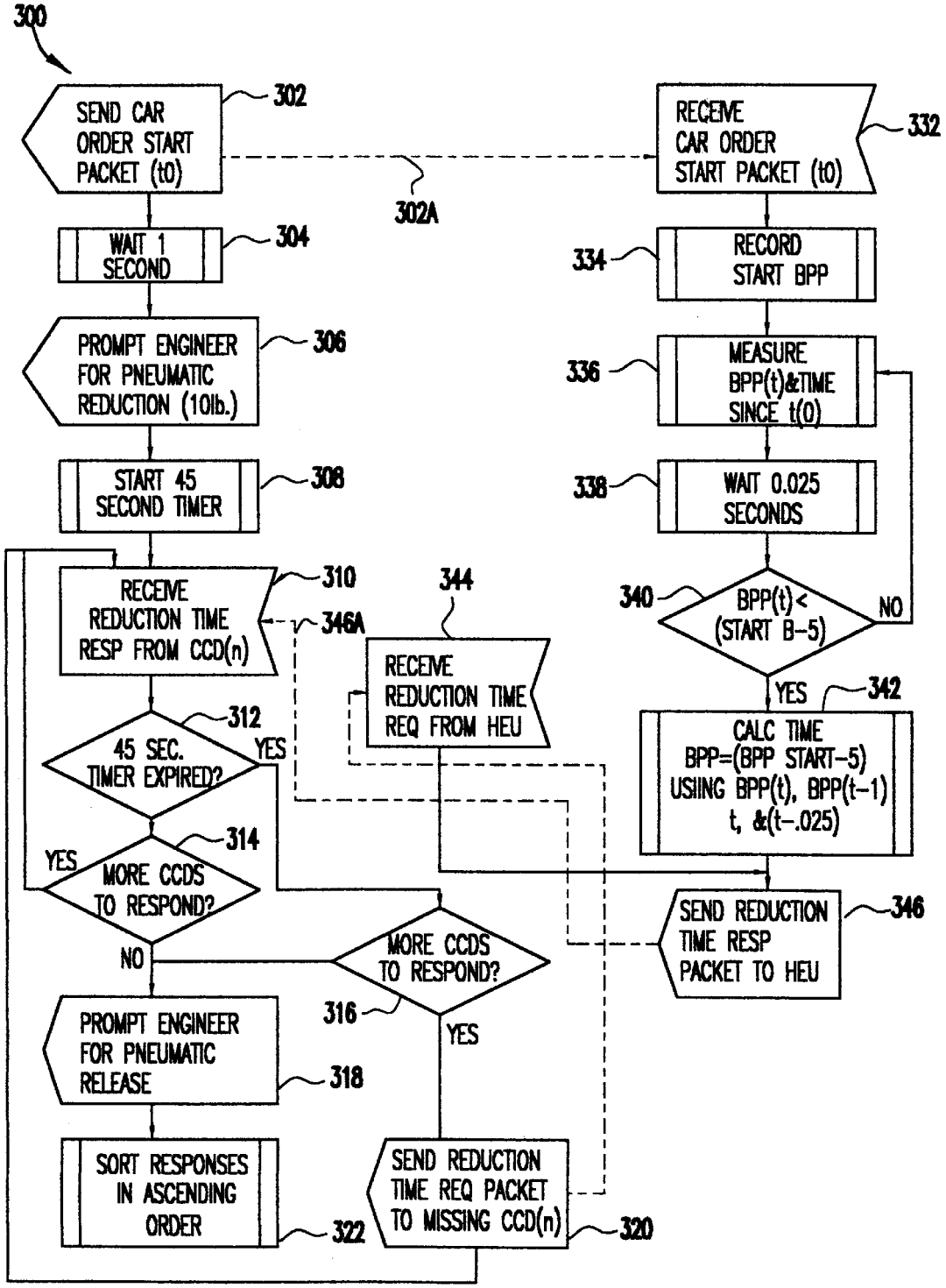
FIG. 3 is a flowchart of the steps of the method of the present invention.

Now referring to FIG. 3, there is shown a flowchart of portions of the process of the present invention generally designated 300 having a first step 302 which involves the Head End Unit (HEU) 140 in the locomotive sending a car order start packet at time t0. Steps 302–322 are performed by the HEU 140 while steps 332–346 are performed by the CCD 210 on each of the railcars. This car order start packet may be transmitted on the electrical power line 130 to each CCD 210. The process of sending the car order start packet to all of the CCDs 210 is represented as dotted line 302A. The HEU 140 then waits one second in accordance with step 304. The one-second time is provided to assure that the car order start packet is received by each car control device 210 and steps 332 and 334, described below, can be performed by the various CCDs 210 during this one-second interval. Next, step 306 is a prompt to the engineer to make a pneumatic reduction by a predetermined amount, which may be 10 pounds. (Note: the pneumatic reduction may be automated in a preferred embodiment. The amount of reduction may be changed in an alternate embodiment.) After the pneumatic reduction, step 308 involves starting a timer for a predetermined interval, which may be 45 seconds. Forty-five (45) seconds may be used if it is believed to be sufficient time for all of steps 332–346 to occur on each of the CCDs 210. Once the 45-second timer has been started, the head end unit 140 waits to receive a reduction time response packet from the various car control devices 210. Essentially, instantaneous with the step 302 is step 332 in which each car control device 210 receives the car order start packet at time t0. As shown in step 334, as soon as the car order start packet is received by the car control devices 210, the car control devices 210 immediately record a starting brake pipe pressure which is recorded by the car control devices 210. In accordance with step 336, the car control devices 210 begin to measure the brake pipe pressure at predetermined intervals as suggested by step 338, which may be 0.025 seconds. If the brake pipe pressure at time t is less than the start brake pipe pressure measured during step 334, less some predetermined amount (in this example, five pounds; however, any brake pipe pressure difference might be used, but in some situations, it may be preferred to use a relatively small brake pipe difference, such as a 0.1 PSI or within a range from 0.03 PSI to 1.0 PSI), then the car control device 210 moves on to step 342. If the brake pipe pressure at time t is greater than the start brake pipe pressure minus the predetermined amount, then the measurement process is repeated by returning to step 336 and then step 338. This process is repeated until the brake pipe pressure at time t is less than the start brake pipe pressure less the predetermined amount. Once this occurs, the car control device 210 then calculates the precise time required for the brake pipe pressure to reach the predetermined limit set in step 340. The precise time of reaching this predetermined limit of step 340 is calculated using some formula which (depending on the exact time set in step 338) may be assumed a linear response. Once a precise time for reaching the limit of step 340 is calculated, that time figure is then provided pursuant to step 346 to the head end unit 140 in a reduction time response packet. Additionally, the packet may be retransmitted to the head end unit 140 in accordance with a request for such packet received from the head end unit 140 in accordance with step 344. Now returning to operation of the head end unit 140, in step 310, the head end unit 140 is shown to receive time responses from the car control device 210. After receiving these responses, the head end unit 140, in accordance with step 312, determines if the timer of step 308 has expired. If the timer has not expired, then in accordance with step 314, the head end unit 140 determines if more car control devices 210 have yet to respond. If more car control devices 210 have yet to respond, then the process steps of 310 and 312 are repeated until either the 45-second timer has expired or it is determined that all of the car control devices 210 have responded. If step 314 determines that all of the car control devices 210 have responded, then the next step is to prompt the engineer to perform a pneumatic release, which is done for the purpose of recharging the brake line. If the 45-second timer has expired, then step 316 requires that a determination of whether more CCDs are required to respond or whether all of the CCDs have responded. If all of the CCDs have responded, then step 318 prompts the engineer for a pneumatic release. However, if the 45-second timer of step 312 has expired and there are still more CCDs to respond, then step 320 requires sending a request for time to the non-responding car control device 210 via the power line 130. The request for time is shown as dotted line 320A.

Once the request for time is received, step 344 will cause step 346 to send a time packet to the head end unit 140 as shown by dotted line 346A. Step 310 then will receive this time response. Step 312 will determine that the time has expired and will repeat the process until step 316 determines that no more CCDs are yet to respond, at which time the engineer is prompted for a pneumatic release and the head end unit 140 performs the function of sorting the responses in ascending order based upon the time intervals provided in the numerous packets. It should be understood that each car in the train will perform the functions 332–346 and included in the time response packet issued in accordance with step 346 is a unique ID for each particular car which responds. The sorting process of step 322 based upon ascending order of time responses will correspond to the actual car order of the train.

Several initial conditions and assumptions are made in relation to the above-described process for determining car order. The brake pipe pressure is assumed to be initially at the set point as established by the engineer. The train line power must be on. All of the CCDs in the train should have been identified using the normal ECP communication protocol, and the train should be stopped. The train's electric brakes should be applied, and the air reservoirs on each car should be fully charged. Further assumptions include that the head end unit (HEU) 140 must not command any changes in brake application during the car ordering process. Similarly, the car control devices (CCD) 210 must not change their brake application during the car ordering process. The reservoirs should be fully charged. To prevent local (to the car) changes in brake pipe pressure which could reduce the accuracy of the car ordering process, no change in the brake application should occur. The reduction in pneumatic pressure of step 306 should be done at a predetermined service rate. "Service rate" refers to the rate of change of brake pipe pressure. "Service rate" reductions do not cause emergency vent valves on cars to activate. "Emergency rate" reductions are undesirable for car ordering because emergency reductions cause cars to individually vent the brake pipe, thereby reducing car ordering accuracy. "Emergency rate" reductions also may cause some types of ECP car to apply brakes, further reducing accuracy. Emergency brake applications use a large amount of air, greatly increasing recovery time.

A simplified variation of the approach of FIG. 3 could eliminate the steps of calculating at the railcar, the precise time to reach the predetermined limit set in step 340, and transmitting only an ID signal (without any calculated time intervals) to the HEU 140 which uses the order of its receipt of the reduction time response packets to determine railcar order.

Figure 4:
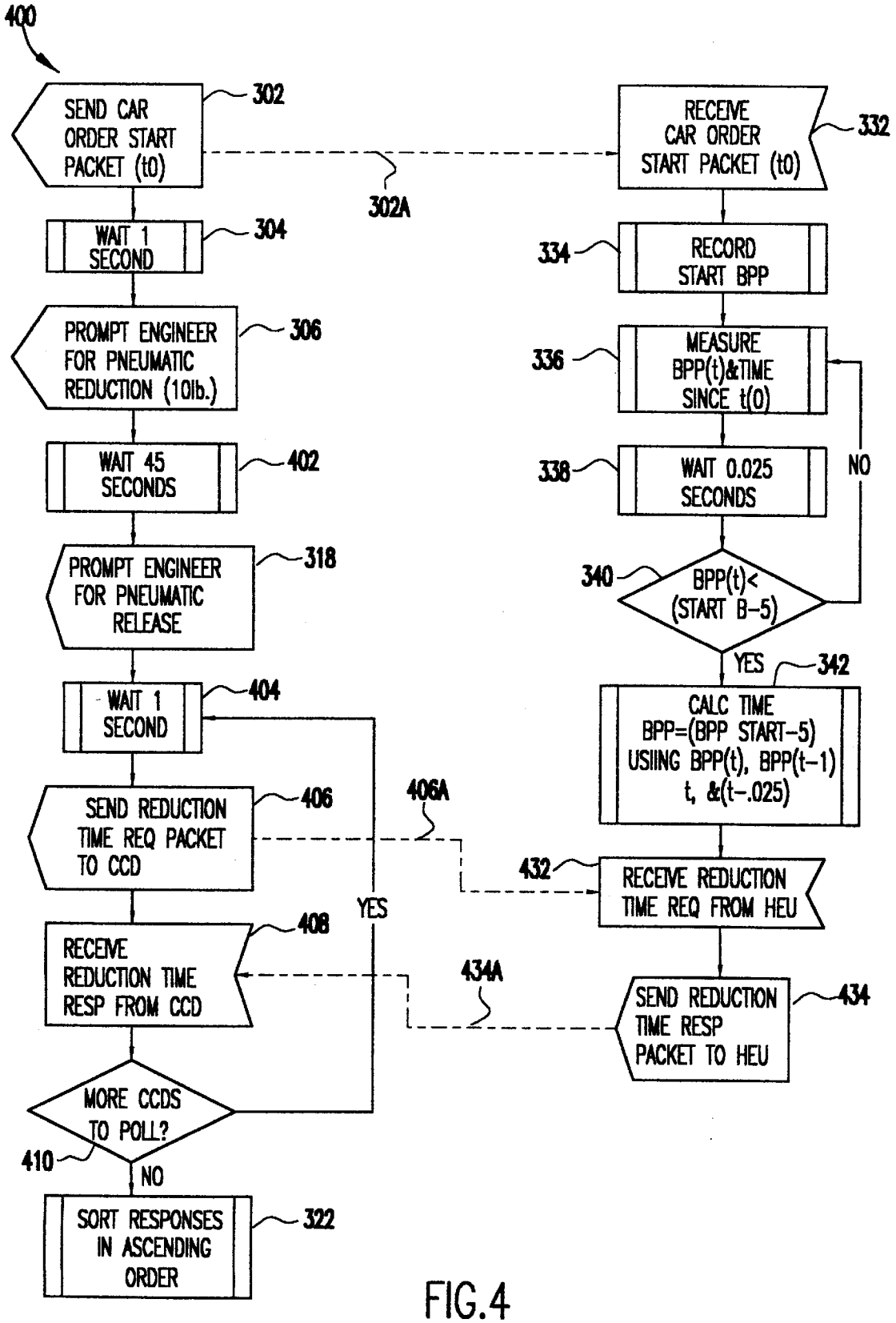
FIG. 4 is a flowchart of an alternate method of the present invention.

Now referring to FIG. 4, there is shown a flowchart of portions of an alternate method of the present invention generally designated 400 in which one of the largest differences is that the HEU 140 polls the CCDs 210 instead of allowing each CCD 210 to respond after it detects the signal. The method includes a first step 302 which involves the head end unit 140 in a locomotive sending a car order start packet at time t0. This car order start packet is transmitted on the electrical power line 130 to the car control device 210. The process of sending the car order start packet to the car control device 210 is represented as a dotted line 302A. The head end unit 140 then waits one second in accordance with step 304. The one-second time is provided to assure that the car order start packet is received by each car control device 210, and steps 332 and 334 described above and below can be performed during the one-second interval. The next step 306 is a prompt to the engineer to effect a pneumatic reduction by a predetermined amount, which may be ten pounds. (Note: In a preferred embodiment, this step might be automated.) After the pneumatic reduction, the next step is to wait 45 seconds in accordance with step 402. Forty-five (45) seconds may be used if it is believed to be sufficient time for all steps 332–342 to occur. At the completion of the 45-second wait, step 318 indicates that the engineer is prompted to perform a pneumatic release. After the pneumatic release, step 404 dictates a wait of one second after which step 406 describes sending a reduction time request packet to the car control devices.

Now referring to step 332–342, 432, and 434, at time t0, the car control devices 210 (assuming nearly instantaneous reception of the car order start packet) receive car order start packet in accordance with step 332. As shown in step 334, as soon as the car order start packet is received by the car control device 210, the car control device 210 immediately records a starting brake pipe pressure which is recorded by the car control device 210. In accordance with step 336, the car control device 210 begins to measure the brake pipe pressure at predetermined intervals as suggested by step 338, which may be 0.025 seconds. If the brake pipe pressure at time t is less than the start brake pipe pressure measured during step 334, less some predetermined amount (in this example, five pounds), the car control device moves on to step 342. If the brake pipe pressure at time t is greater than the start brake pipe pressure minus the predetermined amount, then the measurement process is repeated by returning to step 336 and then step 338. The process is repeated until the brake pipe pressure at time t is less than the start brake pipe pressure less the predetermined amount. Once this occurs, the car control device 210 then calculates the time required for the brake pipe pressure to reach the predetermined level set in step 340. The precise timing of reaching this predetermined level limit of step 340 is calculated, preferably assuming a linear response during the intervals as dictated by 338. Once a precise time for reaching the limit of step 340 is calculated, the time figure is then held until a receipt of a reduction time request from the head end unit occurs in accordance with step 432. Upon receipt of such reduction time request, in accordance with step 434, the car control device 210 sends a reduction time response packet to the head end unit as shown by dotted line 434A. Now returning to the activity at the head end unit 140, in accordance with step 408, the reduction time response is received and then in accordance with step 410, a determination is made if more reduction time responses need to be received from other car control devices. If it is determined that more CCDs 210 need to respond, then the process is repeated through steps 404, 406 which interrogates another car control device 210 which in turn in accordance with its step 434 will respond with a reduction time response packet to the head end unit 140. This process is repeated until all car control devices 210 have been polled and all reduction time responses have been received from every car control device 210 in the train. Once step 410 determines that no more car control devices 210 need be polled, then, in accordance with step 322, the responses are sorted in ascending order. Alternate embodiments may use different combinations of brake pipe pressure reductions and CCD detection pressures. An alternate embodiment may have the CCDs performing the timing measurements on rising instead of falling brake pipe pressure. An alternate embodiment may have the CCD measure both starting and ending brake pipe pressure and using a timing threshold at a precise percentage between these points.

It is thought that the method and apparatus of the present invention will be understood from the foregoing description and that it will be apparent that various changes may be made in the form, construction, steps and arrangement of the parts and steps thereof, without departing from the spirit and scope of the invention or sacrificing all of their material advantages. The form herein described being a preferred or exemplary embodiment thereof.

I claim:

1. A method of determining an order of a plurality of railcars in a train of the type wherein such railcars are linked to a locomotive by a pressurized air line and further are linked to said locomotive by electronic communication, wherein the method includes the steps of:

sending an electromagnetic signal to each of said plurality of railcars for initializing a recording of a baseline pressure in said air line of each of said railcars and generating a baseline air pressure record for each of said railcars;

sending a predetermined pneumatic signal through said air line to said plurality of rail cars;

calculating a time characteristic associated with receipt of said predetermined pneumatic signal by said each of said railcars by detecting a measured air line pressure which is different by a predetermined threshold from said baseline air pressure record for said each of said railcars;

sending a plurality of responses, one from each of said plurality of railcars, representative of said time characteristic to said locomotives;; and sorting said plurality of responses based upon said time characteristic.

2. A method of claim 1 wherein said electronic communication is a power line extending through the train.

3. A method of claim 1 wherein said electronic communication utilizes an RF communication link.

4. A method of claim 2 wherein said step of sending a plurality of response includes responses including a calculated time relating to a propagation delay of said pneumatic signal.

5. A method of claim 4 wherein said responses further include an identification of one of said plurality of railcars.

6. A method of claim 2 wherein said responses include an identification of one of said plurality of railcars.

7. A method of claim 5 wherein each of said plurality of railcars responds only after being addressed by said locomotive.

8. A method of claim 5 wherein each of said plurality of railcars responds without receiving a request for a response by said locomotive.

9. A method of claim 6 wherein said predetermined threshold is within a range of 0.03 to 1.0 PSI.

10. A method of claim 9 wherein said predetermined threshold is substantially 0.1 PSI.

11. An apparatus for determining an order of railcars in a train, the apparatus comprising:

means for electronic communication between a locomotive and a plurality of railcars, wherein said means for electronic communication provides an instruction to each of said railcars to take a baseline air pressure reading;

means for pneumatic communication between a locomotive and a plurality of railcars, said means for pneumatic communication sends a pneumatic signal to said each of said railcars;

means for calculating a time characteristic associated with receipt of said predetermined pneumatic signal by said each of said railcars by detection of an air line pressure of each of said railcars which is different by a predetermined threshold from said baseline air pressure record for each of said railcars; and means for providing said characteristic time to said locomotive so that a rail order determination can be made.

12. An apparatus of claim 11 wherein said means for electronic communication comprises an RF link.

13. An apparatus of claim 11 wherein said means for electronic communication is a power line extending the length of the train.

14. An apparatus of claim 13 wherein said means for pneumatic communication between a locomotive and a plurality of railcars is a brake line.

15. An apparatus of claim 14, further comprising a means of utilizing a known difference between propagation speeds of said means for electronic communication and pneumatic communication which includes a sensor on each railcar for sending a reception of a pneumatic signal.

16. An apparatus of claim 15 further including a timer for detecting a time characteristic corresponding to reception of a predetermined pneumatic signal.

17. An apparatus of claim 16 wherein said means for utilizing a known difference includes a processor for ordering responses from various railcars based upon said time characteristic;

where said means for utilizing uses information based upon order of receipt of messages from various railcars to determine railcar ordering in said train.

18. An apparatus comprising:

a head end unit disposed on a locomotive for coupling with a pneumatic brake line and for generating a predetermined pneumatic signal to be propagated along said pneumatic brake line;

a plurality of railcar air brake signal sensors coupled to said pneumatic brake line and disposed on a plurality of railcars where each of said railcar air brake signal sensors takes a baseline air pressure reading in response to an initialization signal received from the head end unit and generates an electronic signal in response to reception of said pneumatic signal, said electronic signal being a time characteristic associated with receipt of said predetermined pneumatic signal by detecting a measured air line pressure which is different by a predetermined threshold from said baseline air pressure reading for said each of said railcars; and a communication link coupling said railcar air brake signal sensors with said head end unit.

19. An apparatus of claim 18 wherein said electronic signal includes a time characteristic related to a delay between transmission of said pneumatic signal by said head end unit and reception of said pneumatic signal by at least one of said railcar air brake signal sensors.

20. An apparatus of claim 18 wherein said head end unit determines a time characteristic corresponding to a delay of a reception of said pneumatic signal by said railcar air brake signal sensor in which the electronic signal does not include a calculated time data portion.

21. An apparatus of claim 18 wherein, in an order corresponding to increasing distance from said head end unit, said head end unit receives, from each of said plurality of railcar air brake signal sensors, an electronic message containing a unique ID for each of said railcars.

22. An apparatus of claim 18 wherein said head end unit generates an electronic signal on said communication link which initializes each of a plurality of said railcar air brake signal sensors and activates a timer in each of said plurality of railcar air brake signal sensors so that a delayed pneumatic signal can be detected at each of said plurality of railcar air brake signal sensors and compared therein to a common time reference.

23. An apparatus of claim 18 wherein said pneumatic signal is a reduction in air pipe pressure.

24. An apparatus of claim 18 wherein said pneumatic signal is an increase in air pipe pressure.

25. An apparatus of claim 18 wherein said pneumatic signal is a disturbance having a predetermined frequency characteristic.

26. An apparatus of claim 18 wherein said air brake signal sensors generate an electronic signal in response to a change in air pressure which exceeds a predetermined threshold.

27. An apparatus of claim 26 wherein said predetermined threshold is in a range from 0.03 to 2.0 PSI.

28. An apparatus of claim 27 wherein said predetermined threshold is substantially 0.1 PSI.

29. A method of determining an order of a plurality of railcars in a train of the type wherein such railcars are linked to a locomotive by a pressurized air line and further are linked to said locomotive by electronic communication, wherein the method includes the steps of:

sending a predetermined pneumatic signal through said air line to said plurality of railcars;

calculating a time characteristic associated with receipt of said predetermined pneumatic signal by said each of said railcars by detecting a measured air line pressure which is different by a predetermined threshold from said baseline air pressure record for said each of said railcars:

sending a plurality of responses, one from each of said plurality of railcars, where a sending time for each response is representative of said time characteristic of receipt of said predetermined pneumatic signal by said each of said plurality of railcars; and sorting said plurality of responses based upon said sending time.

30. A method of determining an order of a plurality of railcars in a train of the type wherein such railcars are linked to a locomotive by a pressurized air line and further are linked to said locomotive by electronic communication, wherein the method includes the steps of:

sending a signal to each of said plurality of railcars from said locomotive;

recording a baseline air line pressure for said each of said railcars and generating a baseline air pressure record for said each of said railcars;

sending a predetermined pneumatic signal through said air line to said plurality of railcars;

measuring an air line pressure for said each of said railcars at predetermined time intervals, said air line pressure responsive to said predetermined pneumatic signal;

detecting when said air line pressure is less than said baseline air line pressure less a predetermined air line pressure for said each of said railcars;

calculating a time needed for said air line pressure to become less than said baseline air line pressure less said predetermined air line pressure;

sending a plurality of responses to said locomotive for said each of said railcars, said plurality of responses including said calculated time in said calculating step;

determining that said plurality of responses are received at said locomotive from said each of said rail cars; and sorting said plurality of responses based upon said calculated time.

* * * * *